US009416963B2

(12) United States Patent
Armanni

(10) Patent No.: US 9,416,963 B2
(45) Date of Patent: Aug. 16, 2016

(54) COOKING TOP WITH IMPROVED GAS TOP BURNER

(75) Inventor: Piero Armanni, Forli (IT)

(73) Assignee: ELECTROLUX HOME PRODUCTS CORPORATION N.V., Zaventem (BE)

( * ) Notice: Subject to any disclaimer, the term of this patent is extended or adjusted under 35 U.S.C. 154(b) by 1358 days.

(21) Appl. No.: 12/920,671

(22) PCT Filed: Feb. 26, 2009

(86) PCT No.: PCT/EP2009/052271

§ 371 (c)(1),
(2), (4) Date: Jan. 11, 2011

(87) PCT Pub. No.: WO2009/118228

PCT Pub. Date: Oct. 1, 2009

(65) Prior Publication Data

US 2011/0120445 A1 May 26, 2011

(30) Foreign Application Priority Data

Mar. 25, 2008 (EP) ..... 08102892

(51) Int. Cl.
*F24C 3/08* (2006.01)
*F23D 14/06* (2006.01)
(Continued)

(52) U.S. Cl.
CPC *F23D 14/06* (2013.01); *F23D 5/10* (2013.01); *F24C 3/08* (2013.01); *F23D 2900/14062* (2013.01)

(58) Field of Classification Search
CPC ..... F24C 3/08; F24C 3/008; F24C 3/027; F24C 15/10; F23D 5/10; F23D 17/002; F23D 21/005; F23D 2200/00; F23D 2900/14063; F23D 2203/00
USPC ..... 126/39 E, 1 R, 39 R, 218; 99/324
IPC ..... F24C 3/08,3/02, 15/10; F23D 14/06
See application file for complete search history.

(56) References Cited

U.S. PATENT DOCUMENTS 4,627,411 A * 12/1986 Mertler ..... 126/39 E
4,846,671 A * 7/1989 Kwiatek ..... 431/266

(Continued)

FOREIGN PATENT DOCUMENTS

CN 1774599 A 5/2006
EP 0534302 3/1993

(Continued)

OTHER PUBLICATIONS

International Search Report for PCT/EP2009/052271, dated Apr. 6, 2009, 3 pages.

(Continued)

*Primary Examiner* — Gregory Huson
*Assistant Examiner* — Daniel E Namay
(74) *Attorney, Agent, or Firm* — Pearne & Gordon LLP

(57) ABSTRACT

A gas burner for use in cooktops including a lower body, a top cap closing said lower body on top, two coaxial flame rings having the same diameter, but extending at two different heights, a single gas injector, a single Venturi tube, and a single expansion chamber for the gas issuing from said single Venturi tube, said chamber being adapted to supply said two flame rings of the burner. The burner further including a first cylindrically-shaped hollow annular member adapted to be applied vertically upon said lower body, and a second substantially planar hollow annular member adapted to be applied upon said first annular member and support said cap. The lower flame ring is supplied with gas from said expansion chamber via a plurality of ducts arranged within said first cylindrically-shaped annular member. Said two flame rings are provided with gas outlet ports having same or similar cross-section areas.

19 Claims, 9 Drawing Sheets

(51) Int. Cl.

| | |
|---|---|
| ***F23D 5/10*** | (2006.01) |
| *F24C 3/02* | (2006.01) |
| *F24C 15/10* | (2006.01) |

(56) References Cited

U.S. PATENT DOCUMENTS

| | | | | | |
|---|---|---|---|---|---|
| 4,968,246 | A * | 11/1990 | Sasada et al. | 431/264 |
| 5,152,276 | A * | 10/1992 | Brock et al. | 126/39 E |
| 5,160,255 | A * | 11/1992 | Sigler | 431/266 |
| 5,160,256 | A * | 11/1992 | Riehl | 431/266 |
| 5,186,158 | A | 2/1993 | Ferlin | |
| 5,246,365 | A | 9/1993 | Himmel et al. | |
| 5,328,357 | A * | 7/1994 | Riehl | 431/266 |
| 5,649,822 | A * | 7/1997 | Gertler et al. | 431/354 |
| 5,690,483 | A * | 11/1997 | Oda et al. | 431/266 |
| 5,911,572 | A * | 6/1999 | Williams | 431/132 |
| 5,924,860 | A | 7/1999 | Massey et al. | |
| 6,092,518 | A * | 7/2000 | Dane | 126/214 D |
| 6,093,018 | A * | 7/2000 | Avshalumov | 431/352 |
| 6,244,263 | B1 * | 6/2001 | Schlosser et al. | 126/39 R |
| 6,263,868 | B1 * | 7/2001 | Koch et al. | 126/39 R |
| 6,322,354 | B1 | 11/2001 | Carbone et al. | |
| 6,325,619 | B2 | 12/2001 | Dane | |
| 6,332,460 | B1 | 12/2001 | Paesani | |
| 6,537,065 | B1 * | 3/2003 | Shirali et al. | 431/354 |
| 6,589,046 | B2 * | 7/2003 | Harneit | 431/266 |
| 6,780,008 | B2 | 8/2004 | Koch et al. | |
| 6,889,685 | B2 * | 5/2005 | Dane | 126/39 B |
| 7,291,009 | B2 * | 11/2007 | Kamal et al. | 431/284 |
| 7,661,954 | B2 * | 2/2010 | Harneit | 431/278 |
| 7,731,493 | B2 * | 6/2010 | Starnini et al. | 431/354 |
| 8,511,294 | B2 * | 8/2013 | Paesani | 126/39 E |
| 2003/0039935 | A1 | 2/2003 | Harneit | |
| 2005/0164138 | A1 * | 7/2005 | Ruck | F23R 3/343 431/2 |
| 2006/0051718 | A1 * | 3/2006 | Kamal et al. | 431/354 |
| 2007/0059654 | A1 | 3/2007 | Armanni | |
| 2007/0218414 | A1 * | 9/2007 | Harneit | 431/354 |
| 2008/0210216 | A1 * | 9/2008 | Rossi et al. | 126/39 E |
| 2008/0308089 | A1 * | 12/2008 | Tecirlioglu | 126/39 E |
| 2009/0145422 | A1 * | 6/2009 | Paesani | 126/39 E |
| 2009/0205630 | A1 * | 8/2009 | Pottenger et al. | 126/39 E |
| 2010/0051014 | A1 * | 3/2010 | Pryor | F23D 14/06 126/39 E |
| 2011/0120444 | A1 * | 5/2011 | Ryu et al. | 126/39 E |
| 2011/0120446 | A1 * | 5/2011 | Simms et al. | 126/39 E |
| 2011/0232628 | A1 * | 9/2011 | Bettinzoli | 126/39 E |

FOREIGN PATENT DOCUMENTS

| | | | | |
|---|---|---|---|---|
| EP | 0719982 | | 7/1996 | |
| EP | 0797049 | | 9/1997 | |
| EP | 1028286 | A2 * | 8/2000 | F23D 14/06 |
| GB | 2224824 | | 5/1990 | |
| JP | 62029819 | A * | 2/1987 | F23D 14/06 |
| JP | 10030806 | A * | 2/1998 | F23D 14/06 |
| WO | WO 2008033238 | A2 * | 3/2008 | F23D 14/065 |

OTHER PUBLICATIONS

Translation of Office Action in Chinese Patent Application No. 200980103639.X, dated Mar. 1, 2012.

* cited by examiner

COOKING TOP WITH IMPROVED GAS TOP BURNER

The present invention refers to an improved kind of gas top burner, as typically used in cooktops for residential food cooking applications, and a cooking top using said gas burner.

While a gas burner of the above-cited kind will be explained and illustrated in an isolated manner in the following description, it shall be readily appreciated that the invention also extends to cover cooking tops or cooking surfaces that—although not shown—are provided with and use burners of this kind.

Gas burners covered by the present invention are generally known as such in the art, where they are required to meet and comply with a number of definite standard regulations, as well as operating and safety requirements; in addition, they are required to ensure continuously improving performance abilities in terms of overall efficiency.

In particular, the term "efficiency", as used here, must be understood as referring to indicate the fraction of heat issuing from the gas burner—above which there is generally placed a cooking vessel of any commonly used kind—that is actually used to heat up said vessel, as compared to the overall heat amount generated by the combustion of the gas; such overall heat amount, in fact, is partly used to heat up the cooking vessel paced above the burner, while the remaining part, which is in particular contained in the flue gases rising up along the sides of the vessel and slipping away therefrom without transferring any appreciable heat to the same vessel, is wasted into the surrounding environment.

In view of increasing such efficiency, gas burners installed in cooking tops are generally designed and made so as to maximize the amount of heat being generated within as small as possible an area, so as to correspondingly reduce the amount of heat contained in the flue gases wasting away up and along the sides of the cooking vessel.

This is the reason why manufacturers of cooking appliances in general are directing their efforts at designing and providing gas burners that:

- are as compact as feasible;
- for a same overall area of the flame distribution surface thereof, feature a greater number of flame rings;
- ensure that each flame is capable of burning as large as possible an amount of gas, while at the same time ensuring compliance with all other requirements, such as preventing the flames from being too close to each other or being too vulnerable, i.e. liable to problems of the kind that generally goes under the term "flame lift-off" in the art, or—conversely—being such as to give rise to flashback situations, in which flames tend to burn back into the gas injector or injectors, as the case may be.

Furthermore, there is also a fourth requirement, which gas burners are generally due to comply with, and in connection with which a particular circumstance should most appropriately be stressed in this particular case; this is the presence of so-called pilot flames, which—further to strictly technical reasons—is also due to the extent by which the heat output value of flames may or has to be turned down when setting the fuel gas flow to minimum and the burner into simmering operation, i.e. the maximum so-called flame turndown ratio that must be allowed for acceptable burner operation; in certain marketplaces, in fact, such as for instance the US one, the applying standard regulations provide that the minimum flame heat-output level, i.e. the heat output of burner flames adjusted to minimum setting, must be capable of being turned down and adjusted down to as low values as just 6 to 8% of the value of the same burner flames burning at maximum setting.

For such requirement to be able to be satisfactorily complied with, solutions are usually implemented, in which the required heat output rate of the burner is obtained by subdividing the flames into a number of individual flame rings that are provided for being supplied separately through related Venturi tubes and gas injectors and—sometimes—using also separate gas valves and cocks.

In a quite opposite way, the corresponding requirement applying in a number of major European marketplaces calls for a minimum adjustable heat-output rate of burner flames that may not be lower than a value, which may even be as much as 20% of the heat-output rate of the flames burning at maximum setting.

Such circumstance are anyway largely known to all those skilled in the art, so that they shall not be dealt with any further.

The above-cited fourth requirement, therefore, practically derives from and lies in the fact that there exists no particular, definite and strictly limiting requirement as far as the flame turndown ratio is concerned, and that burners are generally designed for operation in accordance with standard regulations as they generally apply to European countries.

In view of being able to concentrate the burner heat output, known in the art is a burner design approach, in which gas burners are provided with a number of individual flame rings in a concentric arrangement relative to each other, forming differently radiused circles, as this is for instance disclosed in the U.S. Pat. No. 6,325,619 B2, which shows three such flame rings issuing from different bodies of the burner.

Although effective in its principle, such solution has however a major drawback and a well-known limitation, wherein the limitation is set by the fact that burners of such kind necessarily and unavoidably have a quite large overall flame surface area and, therefore, are not serviceable, i.e. fit for use when it comes to heat up cooking vessels, whose bottom has an area that is smaller than or even approximately equal to the area of said flame surface of the burner, since a quite considerable fraction of the heat generated by the burner would in this case escape into the surrounding environment without affecting the bottom or even the side surface of the vessel to any appreciable extent.

As a result, although such burners might reasonably be considered as being inherently quite efficient, the actual efficiency thereof turns out as being quite limited, in fact.

The drawback is in turn due to the fact that these burners require the use of gas-carrying devices and parts, such as Venturi tubes, gas supply ducts, caps, and the like, which must be at least doubled, i.e. provided in duplicate, as compared with what is generally required for a burner of traditional design with a single flame ring, so that their costs are caused to increase to a quite appreciable extent.

In view of doing away with such problem, also known in the art is an approach based on providing gas burners with two concentric, coaxial flame rings having a similar diameter, but arranged at two different levels relative to the horizontal plane.

A solution like this is shown in the GB patent no. 2224824 A, wherein the gas burner is provided with two concentric flame rings having the same diameter, which are supplied with gas flowing in from a single supply duct; however, the lower flame ring (combustion ports) acts as just the flame ring supporting the so-called pilot flames.

As is generally known, such pilot flames are only provided and used to ensure continuity, steadiness and regularity to the main flames; as such, they are low-energy flames with a very limited heat output and cannot therefore be used to heat up any vessel, actually.

Accordingly, burners of this kind do not really solve the given problem of providing compact high-efficiency burners.

It quite clearly appears, therefore, that a solution proving to be the optimum one, i.e. giving the best possible results for a given marketplace may not always turn out as being such even on other marketplaces. In other words, under the above-described circumstances, in fact, while a burner that is accepted in the US market would in all cases be accepted also in Europe, the opposite is not necessarily true.

Known from the disclosure in the U.S. Pat. No. 6,244,263 B1 is a kind of burner with a vertical Venturi tube, which is provided with a couple of coaxial flame rings having the same diameter, but extending at different heights relative to each other; even in this case, however, the lower flame ring is intended to just support pilot flames, i.e. is a pilot-flame ring, so that—as far as the actual problem being considered is concerned—such kind of burner shows the same drawbacks as those described in connection with the patent publication cited afore.

Known from the disclosure in the U.S. Pat. No. 6,332,460 B1 is again a kind of burner provided with two distinct coaxial flame rings having the same diameter and extending on two different levels; these two flame rings, however, are supplied with gas flowing in from two different ducts, each one provided with both a Venturi tube and an injector of its own.

As a result, such solution, although basically effective, turns out as being expensive in construction, so that it fails to solve the problem of an acceptably low-cost industrial production.

A kind of burner provided with two concentric flame rings having the same diameter, and extending at different heights from each other, is known also from the disclosure in the U.S. Pat. No. 6,780,008 B2.

Each one of these two flame rings is adapted to ensure a heat output as required to perform a particular kind of cooking process (main flames-simmer flames) and, therefore, might be considered as being effective from an efficiency viewpoint; even in this case, however, the two flame rings are supplied with gas flowing in from two different ducts, each one provided with both a Venturi tube and an injector of its own.

As a result, the construction of the burner becomes even in this case particularly expensive.

Known from the disclosure in the U.S. Pat. No. 7,291,009 B2 is a kind of burner that is fully equivalent—as far as the problems under consideration are concerned—to the one described in the afore-cited patent publication, so that the same conclusions may be drawn, which shall not be repeated here for reasons of brevity. Moreover, such burner does not feature any kind of device or arrangement for the generation of pilot flames and, as a result, the stability and continuity of the flames turn out as being rather delicate and sensitive to variations in the gas properties, as well as to abrupt changes in ambient, i.e. external pressure.

Another burner provided with two concentric flame rings having the same diameter, and extending at different heights from each other, is known from the disclosure in the U.S. Pat. No. 6,322,354 B1.

Even this burner may be considered as being effective from an efficiency point of view; however, the two flame rings are even in this case supplied with gas flowing in from two different ducts, each one provided with a Venturi tube of its own, a respective injector and, in particular, a respective flow-control valve in view of the ability of the two flame rings to be supplied selectively and independently.

Known from the disclosure in EP 0534302 A2 is a gas burner provided with two coaxial flame rings having the same diameter, extending at different heights from each other, and supplied from a same gas expansion chamber, however, the lower flame ring is a pilot-flame ring in which it can be noticed that the supply channel leading to the lower flame ring has a much narrower cross-section than the supply channel leading to the upper flame ring.

As a result, such solution fails again to meet the requirement of the gas burner being capable of ensuring an adequate efficiency.

Known from the disclosure in the U.S. Pat. No. 5,186,158 is finally a gas burner provided with two flame rings that are supplied from a single gas expansion chamber through as single Venturi tube; even in this case, however, one of these two flame rings, namely the upper one, is provided to solely generate pilot flames, so that this burner is practically fully similar to the burner embodiment described in the afore-cited patent publication, of which it of course replicates the limitations and disadvantages.

It would therefore be desirable, and it is actually a main purpose of the present invention, to provide a gas burner and a related cooking top, which are effective in doing away with the above-cited drawbacks found in the prior art, and which are effective in ensuring an optimum efficiency accompanied by a compact size and a fully cost-effective construction, i.e. a construction that is possibly cheaper or—at most—not more expensive than the one of a similar prior-art burner, although accepting a limit-value for the turndown ratio, i.e. the heat output at minimum flow rate, that is not particularly stringent.

According to the present invention, these aims, along with further ones that will become apparent from the following disclosure, are reached in a gas burner and a related cooking top that incorporate the features and characteristics as defined and recited in the appended claims.

Advantages and features of the present invention will anyway be more readily understood from the description that is given below by way of non-limiting example with reference to the accompanying drawings, in which.

Figure 2:
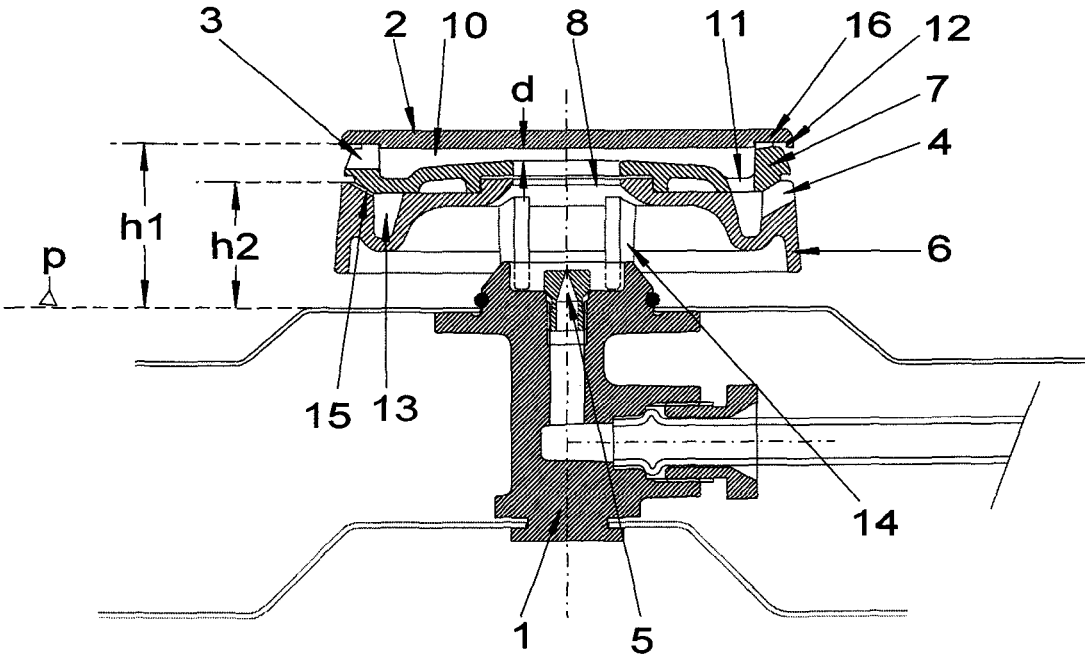
FIG. 2 is a cross-sectional view of the burner along the line A-A in FIG. 1.
Figure 3:
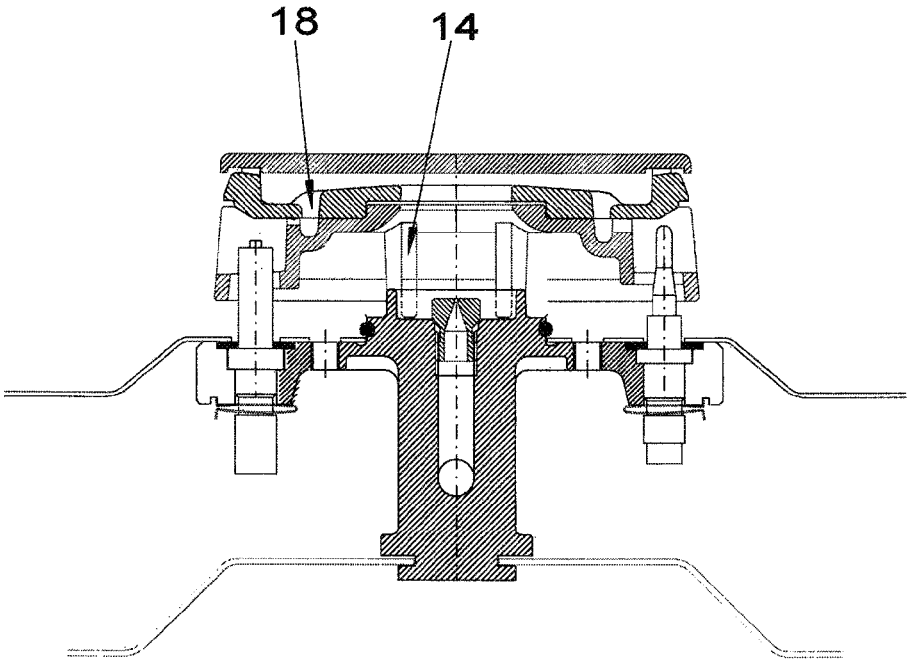
FIG. 3 is a cross-sectional view of the burner along the line B-B in FIG. 1.
Figure 4:
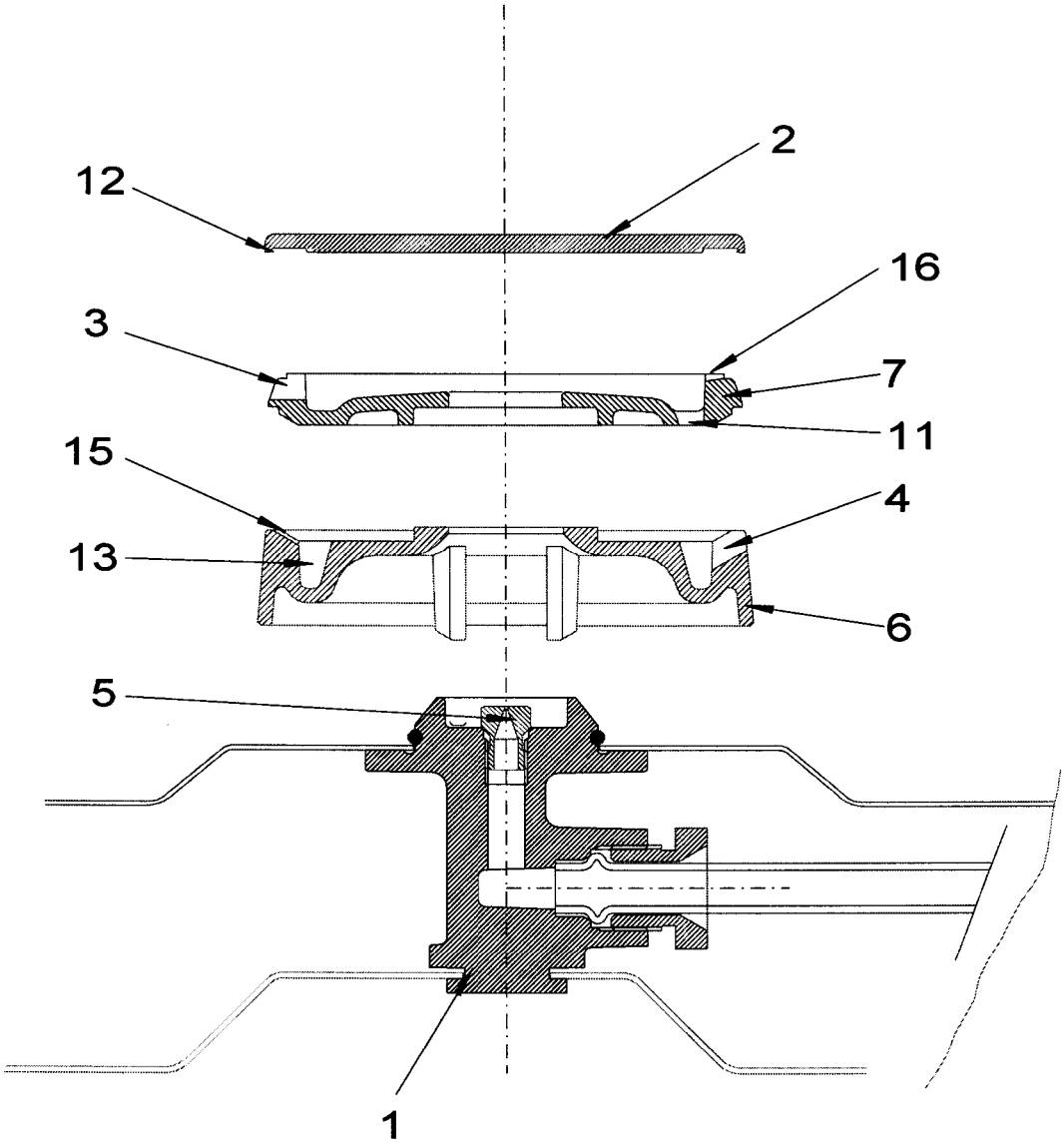
FIG. 4 is a cross-sectional, exploded view of the burner along the line A-A in FIG. 1.

With reference to FIGS. 2 to 4, a gas burner according to the present invention comprises a lower body 1, a top cap 2, and two circular, coaxial flame rings 3, 4 having substantially the same diameter and extending at two different heights h1, h2, relative to a reference horizontal plane p.

As used in the following description, the term "flame ring" shall be understood as meaning the plurality of gas outlet ports, at which the flames start, and which are provided at a same height as regularly distributed along a circular periphery to form a circle around a burner body, regardless of the height or level at which the ports being referred to are provided, actually.

Said lower body 1 of the burner comprises a single injector 5 that faces upwards and is arranged coaxially with said flame rings 3, 4.

Arranged, i.e. preferably simply resting upon said lower body 1 there is a first cylindrically shaped, hollow annular member 6, upon which there is placed a second cylindrically shaped, hollow annular member 7.

These two cylindrically shaped, hollow annular members 6, 7 are substantially coaxial with said injector 5, so that the gas issuing therefrom can be directed upwards by subsequently flowing through said two cylindrically shaped, hollow annular members 6, 7.

In addition, said members are advantageously independent members that can be assembled, i.e. installed separately and are so shaped as to be able to perfectly fit together at their common joining surface in view of ensuring the desired stability of the whole burner assembly, without any need for additional joining or fastening means to be provided.

The first cylindrical annular member 6 is furthermore provided in the shape of an upwards flaring, i.e. widening cylinder, so as to form, with the inner portion thereof, the converging portion 8 of a Venturi tube for the gas exiting the injector 5, as known in the art.

It should however be duly noticed that, although reference is made in this description to an injector 5 and a convergent portion 8 of a Venturi tube that are oriented vertically, the present invention may well be intended as equally and fully applying to burner embodiments, in which said injector and the related Venturi tube are oriented in a different manner, e.g. horizontally.

In the circular outer face of said first cylindrical annular member 6 there is provided a sequence of through-bores forming corresponding radially oriented ports that constitute the lower flame ring 4.

Similarly, provided in the circular outer face of said second cylindrical annular member 7 there is a sequence of through-bores forming corresponding radially oriented ports that constitute the upper flame ring 3.

The upward directed gas issuing from said convergent tube 8 flows into a diverging portion of the Venturi tube so-called expansion chamber 10, which extends horizontally in a roughly circular shape, and is provided to perform so as to both form the final divergent portion of a Venturi tube and convey the in-flowing gas towards said flame rings 3 and 4.

Advantageously, the upper flame ring 3 is supplied from inside directly from said expansion chamber 10 that extends radially up to the circular, slightly raised rim 9 of the second annular member 7.

The above-described embodiment allows for a number of advantageous improvements, actually.

In this connection, a first improvement lies in the fact that the cross-section areas of the ports of said two flame rings 3 and 4 are sensibly equal, so that even the related flames will practically be much similar.

Since a highest possible degree of efficiency of the burner is in fact reached if both flame rings ensure a maximum heat output, compatibly with the actual input flow of fuel gas reaching them, such condition is only met if the individual flames are sensibly equal to each other.

In fact, if the two flame rings were sensibly different from each other, the condition would arise, actually, in which only one of said flame rings would practically generate most of the heat energy output by the burner, whereas the other flame ring would just marginally contribute to it, so that just a single flame ring would prove useful and effective to the desired purpose, actually, thereby leading to a solution that is the exact opposite of the one sought and provided by the present invention, which is based on as even as possible a distribution of the heat energy output by both flame rings.

A second advantageous improvement derives from the fact that said cap 2 is placed to just rest—in a fully natural manner—upon said slightly raised circular rim 9 of the second annular member 7, so that the middle portion thereof comes to lie at a definite distance d from the middle portion of said annular member (neck of the Venturi tube).

As a result, said expansion chamber 10 is provided directly between said cap and said second annular member 7, thereby simplifying the construction of the burner.

A third improvement is obtained in that the ports of the upper flame ring 3 are provided so that they are delimited—on three sides thereof—by the wall thickness of the body of the same second annular member 7, while the fourth side thereof, i.e. the upper side, is open upwards to be then delimited by a corresponding portion of the lower surface of the cap 2.

The actual purpose of this improvement is clearly aimed at further simplifying the construction of said second annular member 7, and further reducing the related production costs, by doing away with any need for through-bores to be drilled therein.

A fourth improvement is best illustrated in FIG. 4; it derives from providing said cap 2 with a stabilisation port facing downwards and obtained by providing a downward extending projection 12 on the outer circular rim thereof, so that such projection 12 is capable of partially intercepting the flow of gas issuing from the upper flame ring 3.

Such partial interception has the effect of bringing about a slight vortex, i.e. whirling flow in front of each one of said ports of the upper flame ring 3, thereby improving the stability of the related flames, as this has been repeatedly found experimentally.

A fifth improvement more closely relates to the lower flame ring 4, in which even this lower flame ring is advantageously supplied by the gas flowing in from the same expansion chamber cited afore, since a plurality of downward oriented through-apertures 11 are provided according to an approximately circular pattern in said second cylindrically shaped, hollow annular member 6 (see FIGS. 1 and 2), so that the gas from said expansion chamber 10 is able to flow through said through-apertures 11, from which it then flows into respective inner ducts 13 terminating into the ports of said lower flame ring 4.

Fully apparent is therefore the really great simplicity of the construction of the inventive burner, which can therefore be provided to be solely comprised—further to the body 1 and the cap 2—of just two members 6 and 7 that perform as Venturi tube, expansion chamber and double flame ring altogether, the whole assembly being able to be produced in as simple and low-cost a manner as possible.

A sixth improvement refers to the first cylindrically shaped, hollow annular member 6, wherein in view of enabling the required amount of primary air to reach into the Venturi tube, said first hollow annular member 6 is provided with appropriate side apertures 14 opening up radially sideways, so that they enable primary air to be taken in from a zone lying above the cooking top, as this is known to be largely preferable due to reasons that are well known to all those skilled in the art.

Figure 1:
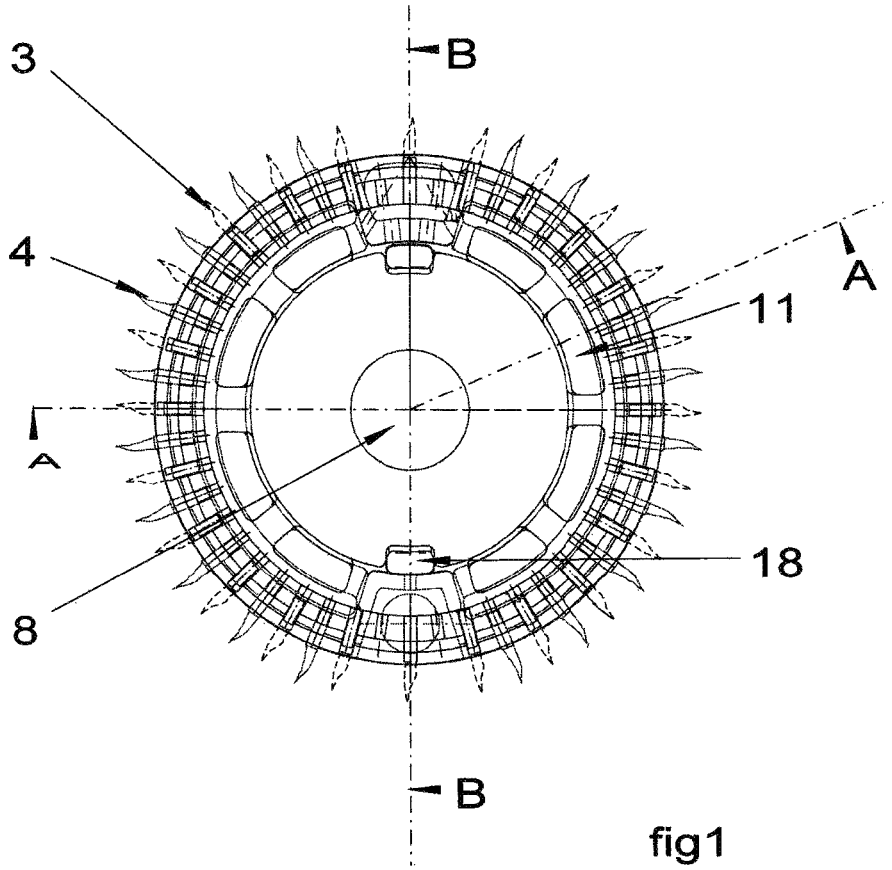
FIG. 1 is a top view of a burner according to the present invention, with the cap thereof removed.

A seventh improvement relates to the mutual arrangement of the two flame rings 3 and 4. With reference to FIG. 1, these flame rings, in a projection on a horizontal plane thereof, can be noticed to be arranged so that the flames issuing from the two rings alternate each other, i.e. are offset relative to each other.

Such mutual arrangement has been found to be particularly advantageous since it is substantially the entire circular periphery, i.e. circumference of the burner that is occupied by the flames from either one of the two flame rings, while—in this way—the same flames fail to overlap each other, thereby avoiding the risk of subtracting oxygen from each other, and—at the same time—ensure the additional advantage of producing a more extended, substantially continuous flame surface directly touching or affecting the bottom of the cooking vessel.

Figure 5:
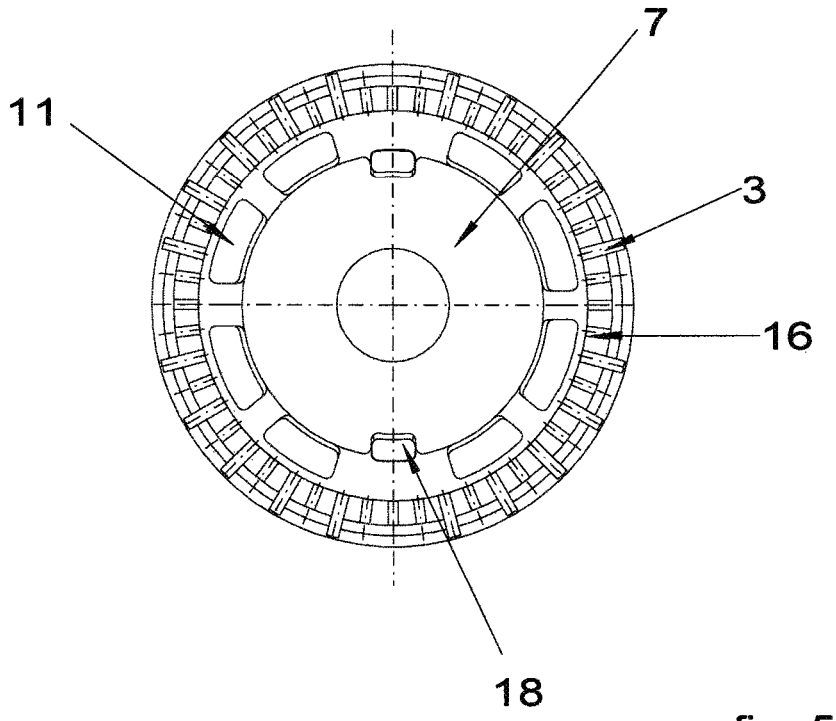
FIG. 5 is a plan view of a component part (annular member 7) of the burner shown in FIG. 1.
Figure 6:
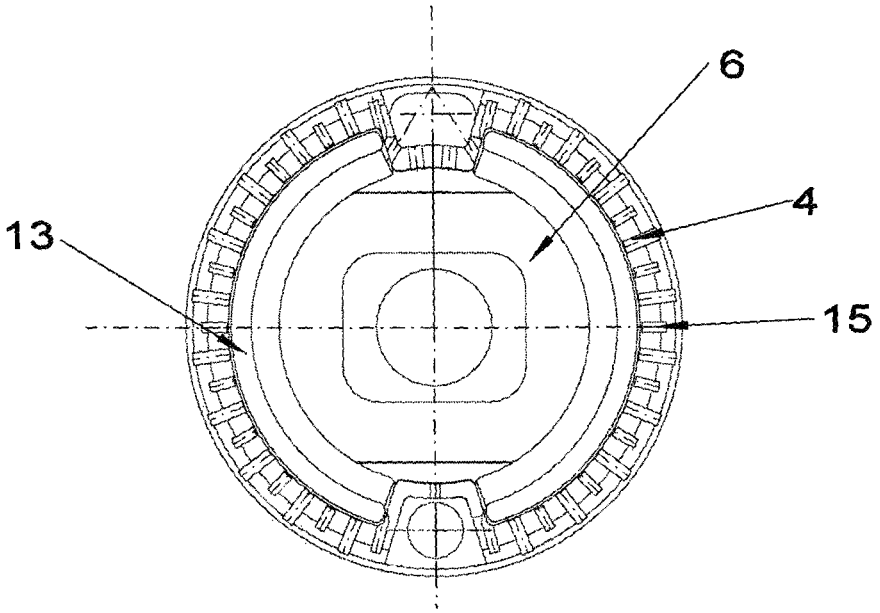
FIG. 6 is a plan view of a different component part (annular member 6) of the burner shown in FIG. 1.

A further, eighth improvement relates to the pilot flames; as a matter of fact, and with reference to FIGS. 5 and 6, both flame rings 3 and 4 of the burner may be advantageously provided with respective pilot flames 15 and 16, whose purpose and function are largely known to all those skilled in the art.

In a most simple manner, and without this implying any additional cost, these pilot flames can be provided as follows:

as far as the lower flame ring 4 is concerned, the pilot-flame ports 15 are alternately positioned between the main-flame ports 4, and are covered by the lower rim of the second cylindrical annular member 7, wherein such rim is so shaped as to be able to both ensure flame propagation and flame stabilization;

as far as the upper flame ring 3 is concerned, a same concept is basically applied, wherein the pilot-flame ports 16 are alternately positioned between the main-flame ports 3.

In addition, fully apparent is in this case the fact that the afore-cited downward-extending projection 12 of the cap 2 becomes particularly useful, since it acts in a fully direct manner upon such pilot flames, which burn contiguously thereto, thereby improving the air-gas mixing effect and, as a result, making it much easier for the same flames to be ignited and kept burning in a way that ultimately leads to an increased overall safety of the whole burner.

Fully apparent from the above description is therefore the ability of the present invention to readily reach the afore-indicated aims, and meet the afore-specified requirements, by providing a gas burner that is particularly compact, ensures a high efficiency, is capable of being manufactured in a quite simple and low-cost manner, and is further adapted to be most advantageously used in all those countries/marketplaces, in which the value of the so-called turn-down ratio, i.e. the requirement concerning the lowest adjustable heat output of the flames as compared with the heat output at full gas flow rate, is not particularly stringent or binding.

It will be readily appreciated that the present invention extends to also cover all cooking tops and surfaces that use burners according to the description given above and incorporating the features defined in the appended claims, wherein the construction of a cooking top designed and made to include such burner, or burners, is well within the abilities of those skilled in the art, so that any further description thereof will be omitted here.

Figure 7:
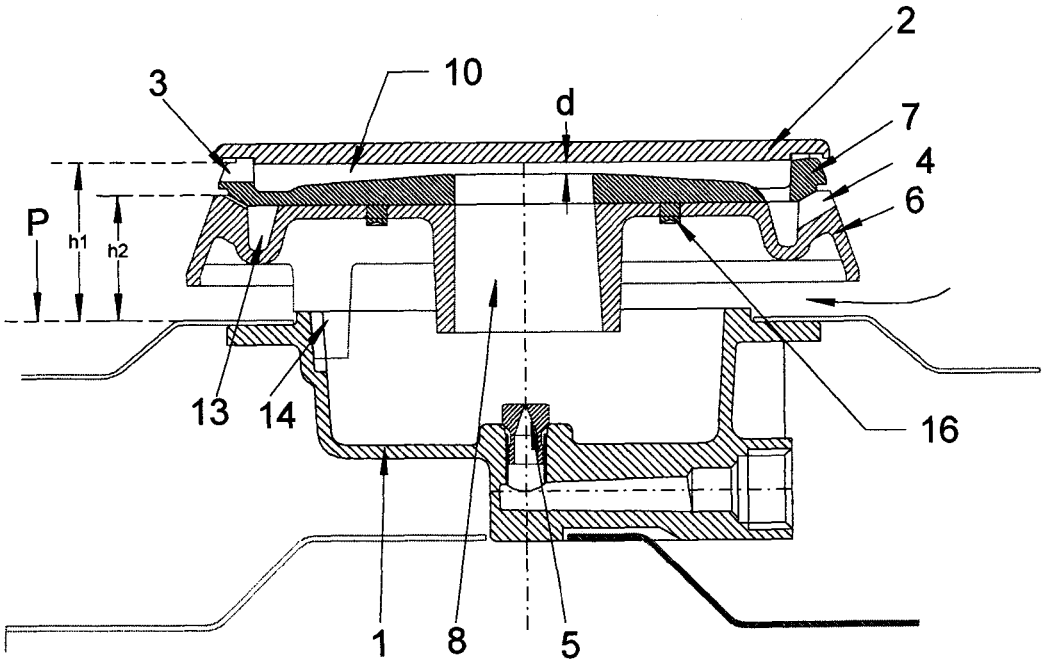
FIG. 7 is a planar vertical cross-sectional view, along the section line A-A in FIG. 1, of an alternative embodiment of a burner according to the present invention.
Figure 8:
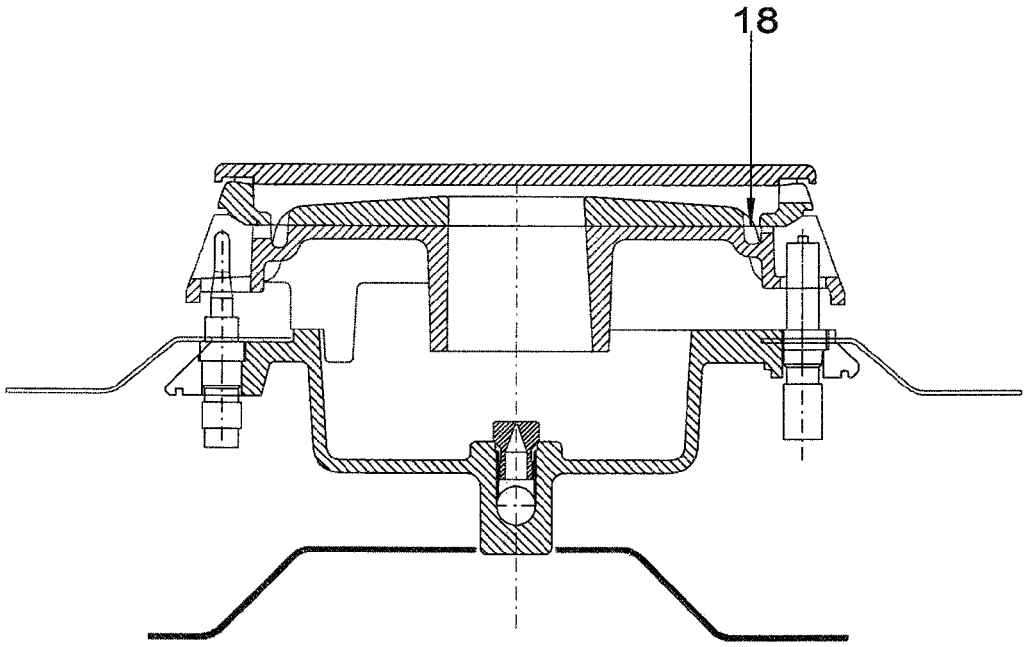
FIG. 8 is a planar vertical cross-sectional view, along the section line B-B in FIG. 1, of the burner embodiment shown in FIG. 7.
Figure 9:
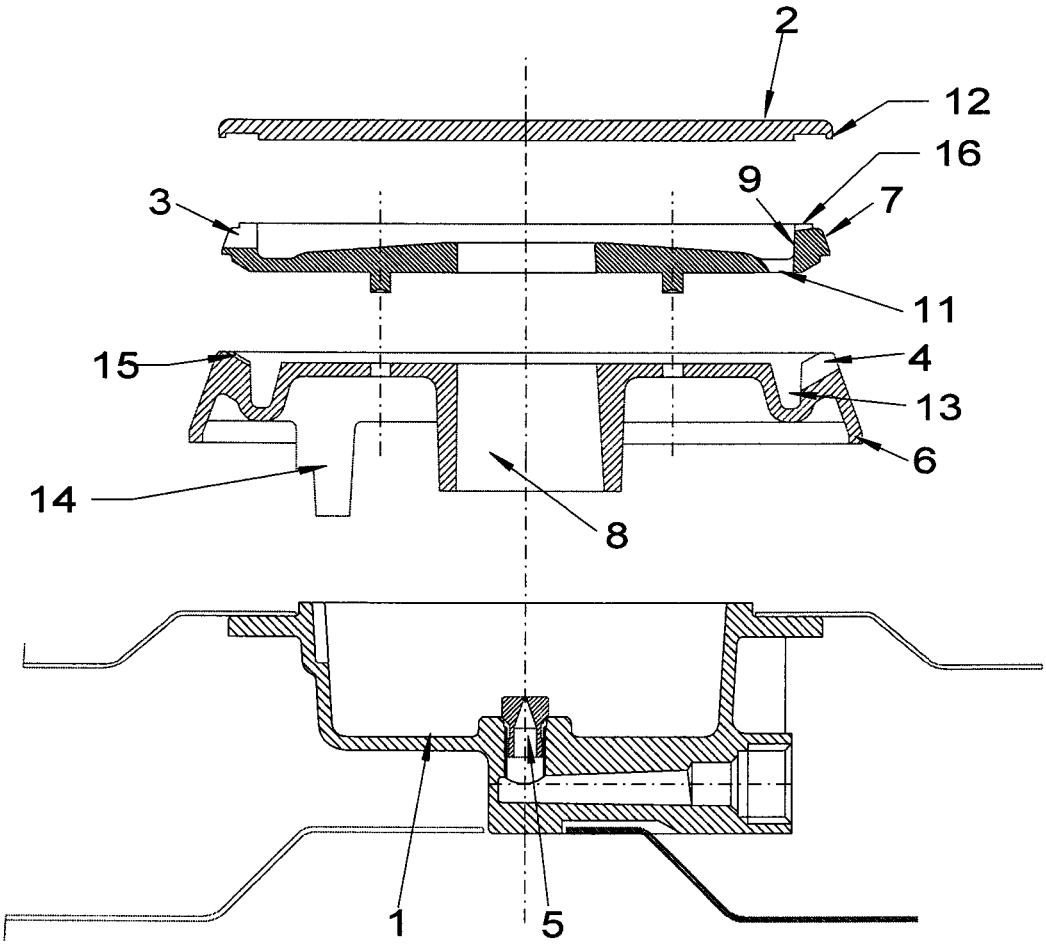
FIG. 9 is an exploded view of the burner embodiment shown in FIGS. 7 and 8.

There is furthermore an alternative manner in which the gas burner according to the present invention may be embodied; as best illustrated in FIGS. 7 to 9, this alternative embodiment anyway differs from the afore described one solely in that the convergent portion 8 of the Venturi tube is in this case constituted by a duct—as generally indicated at 18 in the above-cited Figures—that extends downwards from said second annular member 7, so as to enable the whole flame carrying assembly of the burner, i.e. the assembly comprising the two members 7 and 8 and the cap 2, to be placed to directly rest upon the bottom portion 1 of the burner body.

While this alternative embodiment does not differ from the afore-described one as far as the way in which the burner operates and works, actually, it ensures a twofold advantage in terms of both costs and construction over the afore considered embodiment, in that the whole flame-carrying assembly—as this has been just defined above—may be applied without any modification to existing burners of practically any currently produced kind, which in turn do not require any modification or adaptation to this purpose, thereby allowing for an advantageous and readily-done interchangeability of the various burner flame-carrying assemblies.

The invention claimed is:

1. A gas burner for cooktops comprising:

a lower body;

a top cap, which closes said lower body on top;

a first cylindrically-shaped hollow annular member adapted to be independently applied upon said lower body;

a second substantially hollow annular member adapted to be independently applied upon said first annular member;

an upper coaxial flame ring and a lower coaxial flame ring, the upper and lower flame rings having a same diameter but extending at two different heights, the flame rings having gas outlet ports arranged peripherally along the flame rings, wherein the gas outlet ports provided along said upper and lower flame rings have a same or similar cross-section area;

a single gas injector;

a single Venturi tube comprising a vertical convergent portion and a single expansion chamber for gas issuing from said single Venturi tube, said chamber being adapted to supply said upper and lower flame rings of the burner; and a plurality of pilot flames affecting said lower flame ring, wherein the pilot flames are obtained by means of an upper contour of an outer rim of said first cylindrically-shaped hollow annular member, wherein the lower flame ring is supplied with gas from the expansion chamber via a plurality of ducts which are arranged within an outer portion of said first annular member, and wherein an upper side of the gas outlet ports in the lower flame ring is delimited by said second annular member.

2. The gas burner according to claim 1, wherein said cap forms a wall delimiting said expansion chamber upwards.

3. The gas burner according to claim 2, wherein said cap forms a wall closing on top the outlet ports of the upper flame ring.

4. The gas burner according to claim 3, wherein said cap is provided with a downward-oriented projection extending along an outer circumference of said cap for stabilization purposes.

5. The gas burner according to claim 1, wherein the first cylindrically-shaped hollow annular member comprises a divergent portion of the Venturi tube.

6. The gas burner according to claim 5, wherein said first cylindrically-shaped, hollow annular member is provided with side apertures adapted to enable air to flow therethrough from outside towards said Venturi tube.

7. The gas burner according to claim 1, wherein a plurality of downward-oriented through-apertures are provided in said second annular member in such arrangement as to enable them to correspond to and flow into respective ones of said ducts provided inside said first annular member.

8. The gas burner according to claim 1, wherein the outer rim of said first cylindrically-shaped, hollow annular member remains separated, at some portions thereof that are spaced from each other, from an outer rim of the second annular member extending thereabove.

9. The gas burner according to claim 8, wherein the plurality of pilot flames affecting said lower flame ring are alternatingly spaced with respect to the gas outlet ports of the lower flame ring.

10. The gas burner according to claim 1, further comprising: a plurality of pilot flames affecting said upper flame ring, these pilot flames being obtained by providing an upper outer rim of the second annular member with an appropriate contour that enables it to remain slightly separated from said cap, thereby forming a respective way-out for the gas to be able to escape from said expansion chamber.

11. The gas burner according to claim 10, wherein the plurality of pilot flames affecting said upper flame ring are alternatingly spaced with respect to the gas outlet ports of the upper flame ring.

12. The gas burner according to claim 1, wherein said vertical convergent portion of the Venturi tube rests directly upon said lower body of the burner.

13. The gas burner according to claim 1, wherein said first hollow annular member is provided with side apertures opening radially sideways, so that they enable primary air to be taken from a zone lying above a cooking top.

14. The gas burner according to claim 1, wherein the gas outlet ports of the upper and lower flame rings are offset with respect to each other.

15. The gas burner according to claim 1, wherein the gas outlet ports of the upper and lower flame rings are radially oriented with respect to a central axis of the burner.

16. A gas burner for cooktops comprising:

a lower body;

a top cap, which closes said lower body on top;

a first cylindrically-shaped hollow annular member adapted to be independently applied upon said lower body;

a second substantially hollow annular member adapted to be independently applied upon said first annular member;

an upper coaxial flame ring and a lower coaxial flame ring, the upper and lower flame rings having a same diameter but extending at two different heights, the flame rings having gas outlet ports arranged peripherally along the flame rings;

a single gas injector;

a single Venturi tube comprising a vertical convergent portion and a single expansion chamber for gas issuing from said single Venturi tube, said chamber being adapted to supply said upper and lower flame rings of the burner, wherein the lower flame ring is supplied with gas from the expansion chamber via a plurality of ducts which are arranged within an outer portion of said first annular member, and wherein an upper side of the gas outlet ports in the lower flame ring is delimited by said second annular member; and a plurality of pilot flames affecting said lower flame ring, these pilot flames being obtained by means of an upper contour of an outer rim of said first cylindrically-shaped, hollow annular member which remains separated, at some portions thereof that are spaced from each other, from an outer rim of the second annular member extending thereabove.

17. The gas burner according to claim 16, wherein the pilot flames are spaced from each other at regular intervals.

18. The gas burner according to claim 16, further comprising: a plurality of pilot flames affecting said upper flame ring, these pilot flames being obtained by providing an upper outer rim of the second annular member with an appropriate contour that enables it to remain slightly separated from said cap, thereby forming a respective way-out for the gas to be able to escape from said expansion chamber.

19. The gas burner according to claim 18, wherein the plurality of pilot flames affecting said lower flame ring are alternatingly spaced with respect to the gas outlet ports of the lower flame ring, and wherein the plurality of pilot flames affecting said upper flame ring are alternatingly spaced with respect to the gas outlet ports of the upper flame ring.

* * * * *